United States Patent [19]

Shaffer

[11] 4,082,494

[45] Apr. 4, 1978

[54] PHOTOFLASH LAMP

[75] Inventor: John W. Shaffer, Williamsport, Pa.

[73] Assignee: GTE Sylvania Incorporated, Stamford, Conn.

[21] Appl. No.: 748,628

[22] Filed: Dec. 8, 1976

[51] Int. Cl.[2] ..... F21K 5/02

[52] U.S. Cl. ..... 431/95 R; 362/10

[58] Field of Search ..... 431/93, 94, 95; 240/1.3; 313/210

[56] References Cited

U.S. PATENT DOCUMENTS

| | | | |
|---|---|---|---|
| 3,884,615 | 5/1975 | Sobieski | 431/95 R |
| 3,930,784 | 1/1976 | Anderson | 431/93 |

*Primary Examiner*—Carroll B. Dority, Jr.
*Assistant Examiner*—Robert J. Charvat
*Attorney, Agent, or Firm*—Edward J. Coleman

[57] ABSTRACT

A high-voltage type photoflash lamp having a nonconducting, noncombustible, fibrous material, such as zirconia wool, positioned around the lead-in wires at the base of the lamp to prevent shorting across the wires.

10 Claims, 3 Drawing Figures

PHOTOFLASH LAMP

BACKGROUND OF THE INVENTION

This invention relates to photoflash lamps and, more particularly, to flashlamps of the type containing a primer bridge, or the like, ignited by a high voltage pulse.

Such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as shredded zirconium or hafnium foil, and a combustion supporting gas, such as oxygen, at an initial fill pressure of several atmospheres.

Lamp functioning is initiated by application of a high voltage pulse (e.g., several hundred to several thousand volts as, for example, from a piezoelectric crystal) across the lamp lead-in wires. The mass of primer within the lamp then breaks down electrically and ignites; its deflagration, in turn, ignites the shredded combustible which burns actinically.

Several different constructions for high voltage flashlamps have been described in the prior art. The following U.S. Pat. Nos. are examples: 2,718,771; 2,768,517; 2,771,765; 2,868,003; 3,000,200; 3,312,085; 3,501,254; 3,556,699; 3,602,619; 3,627,459; 3,685,947; 3,721,515; 3,823,994; 3,873,260; 3,873,261; and 3,884,615. All of these constructions have either been difficult to fabricate, contained extra and costly glass components, or suffered from shred-caused preflash short circuits. Some of the referenced constructions are not adaptable to miniaturization and use in multilamp flash devices of modern design. Many require the use of intricate, tiny glass parts that are very expensive, difficult to feed, and to orient and slip over the lead wires on automated high speed lamp making machinery. Reliable automated primer application would not be feasible with some of the designs. Other designs would so vary in firing voltage from one lamp to another that reliable operation could not be attained with the voltages and energy levels available from miniaturized piezoelectric sources that would fit in the present small cameras. Some of the constructions fail to recognize the problem of shred shorting or shred interference with ignition.

SUMMARY OF THE INVENTION

In view of the foregoing, it is an object of this invention to provide an improved photoflash lamp construction.

A particular object of the invention is to provide an improved construction for miniature high-voltage type, photoflash lamps which is readily adapted to automated assembly, eliminates the need for expensive lamp components such as glass beads or sleeves, and substantially precludes the troublesome problem of shred-caused short circuits prior to flashing.

These and other objects, advantages and features are attained, in accordance with the principles of this invention, by positioning a quantity of electrically nonconducting, noncombustible, fibrous material around at least one of the lead-in wires near the base of the lamp to reduce the possibility of electrical shorting between the pair of lead-in wires sealed within the envelope. In a preferred embodiment, the lead-in wire terminations within the lamp envelope are spaced apart to provide a predetermined gap which is bridged by a mass of the primer material, and a wad of glass or ceramic fibers extends from the base of the lamp to about the top of the primer bridge and is held in place by the filamentary combustible material in the lamp.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
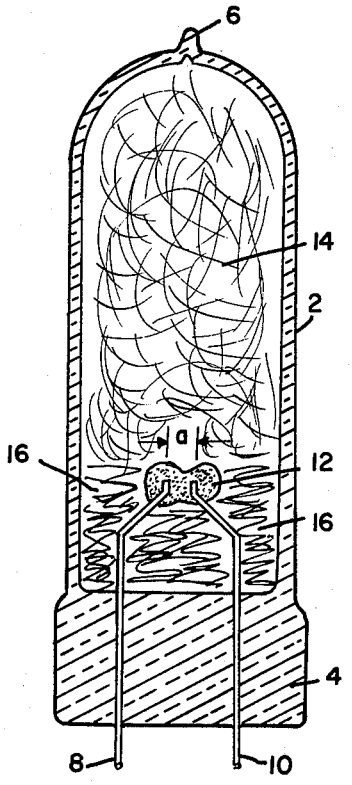
FIG. 1 is an enlarged sectional view of one embodiment of a photoflash lamp in accordance with the invention, wherein the lead-in wires are bridged with primer material.

Referring to FIG. 1, the high voltage type flashlamp illustrated therein comprises an hermetically sealed light-transmitting envelope 2 of glass tubing having a press 4 defining the base end thereof and an exhaust tip 6 defining the other end thereof. Supported by the base press 4 is an ignition means including a pair of metal lead-in wires 8 and 10 extending through and sealed into the base press in a spaced apart relationship. The ends of the lead-in wires within the envelope are spaced apart to provide a predetermined gap "*a*" therebetween. A mass of primer material 12 bridges the ends of the lead-in wires 8 and 10 across the gap "*a*." The primer material may be composed of a combustible metal powder and a binding agent; for example, about 99.0 percent by weight of zirconium powder and 1.0 percent by weight cellulose nitrate on a dried basis. The primer may be applied by the conventional dip process and then dried. Other suitable primer materials are described in copending application Ser. Nos. 673,569 and (D-8770-L), both filed in 1976 and assigned to the present assignee. The primer composition may also include an oxidizer, such as sodium chlorate or potassium chlorate, but this is not as desirable.

Typically the lamp envelope 2 has an internal diameter of less than one centimeter and an internal volume of less than 1 cubic centimeter. A quantity of filamentary combustible fill material 14, such as shredded zirconium or hafnium foil, is disposed within the lamp envelope. The envelope 2 is also provided with a filling of combustion supporting gas, such as oxygen, at a pressure of several atmospheres. Typically, the exterior surface of the glass envelope 2 is also provided with a protective coating such as cellulose acetate (not shown).

In accordance with the present invention, the interior of the lamp envelope further includes a quantity of electrically nonconducting, noncombustible, fibrous material 16 which is positioned so that it fills the region from the base press 4 up to about the top of the primer bridge 12.

In making the lamp, the fibrous material 16 is the first fill ingredient to be introduced into the envelope. After tamping the fibrous fill 16 toward the base of the lamp, a quantity of the filamentary combustible, such as zirconium or hafnium foil, is then admitted into the lamp and the top of the envelope is constricted. A charge of combustion supporting gas, such as oxygen, is introduced into the lamp and the envelope is then tipped off at the constriction 6. The filamentary metallic combustible should be unannealed, or springy enough to hold the wad of fibrous insulation 16 in place during handling or shipping of lamps.

The fibrous insulation 16 is preferably of a glass or ceramic type material. Among the ceramic fiber candidates for this application are fiberglass, silica, silicates, oxides of reactive metals such as zirconia, alumina, etc., and mixed oxides. The fibers used should be fine enough so that no significant abrasive action is experienced by the primer bridge. The fiber tensile strength should be low enough that fibers, rather than the primer bridge, are broken when necessary during the tamping operation. A combination of good fiber stiffness and fine cross section (with low fiber mass per unit length) aids in maintaining the quantity of fibrous insulation in place in the lamp. It is contemplated that fluoropolymers such as Teflon, FEP, etc., as well as fluorosilicones, can possibly be used in that they are noncombustible in oxygen. Other synthetic polymers, of an essentially inorganic nature, can also conceivably be used so long as they do not burn in oxygen.

One convenient way to introduce the fibrous insulation in measured quantities is to chop lengths of loosely twisted roving or fiber bundles and to then both separate and transport the fibers by a flow of compressed air. This would closely relate to the well-developed technique of transporting the shredded metal foil and blowing it into a lamp. Other methods of automatically dispensing and introducing repeatable quantity of fibrous insulation will be apparent to those skilled in the art. Blow-in is generally followed by a tamping operation.

Figure 2:
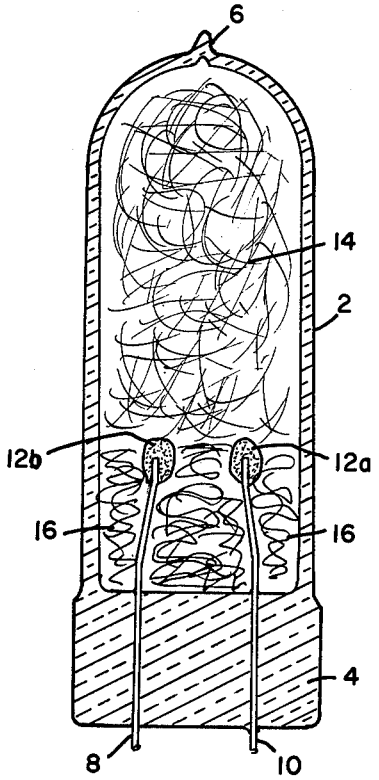
FIG. 2 is an enlarged sectional view of a variation of the lamp of FIG. 1, wherein primer coatings on the lead-in wires are spaced apart without bridging.

FIG. 2 shows a variation of the ignition structure wherein the respective primer coatings 12*a* and 12*b* on the lead-in wires 8 and 10 are spaced apart from each other.

Operation of the high voltage flashlamps of FIGS. 1 and 2 is initiated when a high voltage pulse from e.g., a piezoelectric crystal, is applied across the two lead-in wires 8 and 10. Electrical breakdown of the primer causes its deflagration which, in turn, ignites the shredded metallic combustible 14. In the lamp of FIG. 1, the spark discharge occurs through the primer bridge 12. In the lamp of FIG. 2, however, the foil 14 substantially fills the envelope 2 and is in contact with both of the respective primer coatings 12*a* and 12*b* so as to form an electrically conducting path therebetween for formation of a spark discharge between the lead-in wires and the foil through the respective primer coatings upon application of a high voltage pulse across the lead-in wires. Hence, in high speed automatic production processing, it is not critical whether the primer bridges the leads or not; it is only necessary that the foil provides contact between the separated primer coatings.

By way of specific example, glass lamps such as those illustrated in FIG. 1 were provided with an envelope 2 formed from 0.259 inch O.D. tubing of borosilicate glass known commerically as Corning Type 7052 glass. The internal volume was 0.32 $cm^3$; the quantity of combustible material 14 was 29 milligrams of 4 inches long hafnium shreds having a cross section of 0.0009 × 0.0010 inch; the oxygen fill pressure was 13.1 atmospheres. The lead-in wires 8 and 10 were 0.14 inch diameter and formed of a metal alloy of iron, nickel and cobalt which is known commerically as Rodar or Kovar; the primer bridge gap length "*a*" was 0.020 inch on the average; and the primer material comprised about 99% by weight zirconium powder and 1% by weight nitrocellulose. About 2 mgs. of primer material was used in each lamp. Zirconia wool was placed in the bottom of the lamps up to the height of the primer bridge as illustrated in FIG. 1. Thirty of these lamps were photometered, using a 2,500 volt piezoelectric source for ignition. The photometric results were as follows:

| Pk. Time ms. | Pk. Height megalumen | Output 0–40 sec. lum-sec. | Total Output lum-sec. |
|---|---|---|---|
| 18.3 | 0.353 | 5,489 | 5,681 |

In a second test, similar lamps were fabricated and flashed so as to test for shred-induced, preflash short circuits. A total of 109 lamps were flashed with no evidence of shred shorting.

The advantages of the lamp construction disclosed herein include the following: (a) manufacture is noncomplicated and readily automatable, (b) preflash shred shorts are eliminated, (c) no expensive or difficult to handle glass sleeves or beads are used, (d) the primer bridge gap length is closely controllable, thereby permitting attainment of both high reliability and maximum resistance toward inadvertent electrostatic-induced ignition, and (e) the mat of fibrous refractory insulation helps to protect the lower region of the lamp vessel from the virtual "rain" of hot, molten droplets of metal oxide from the lamp combustion.

Figure 3:
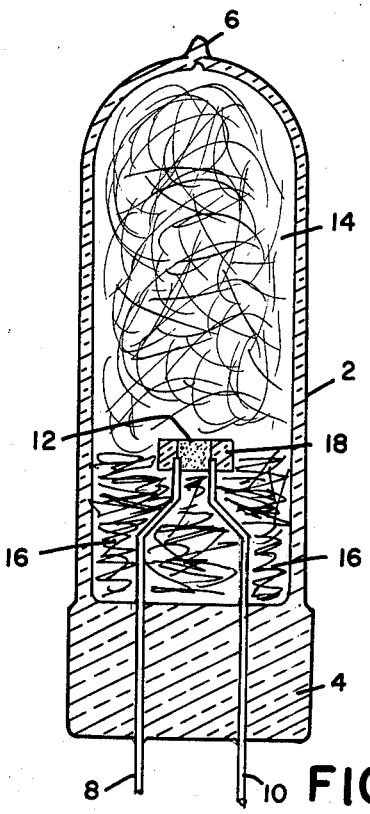
FIG. 3 is an enlarged sectional view of another embodiment of a photoflash lamp in accordance with the invention, wherein a glass bead is sealed about the lead-in wires.

Although the invention has been described with respect to a specific embodiment it will be appreciated that modifications and changes may be made by those skilled in the art without departing from the true spirit and scope of the invention. For example, the lead wires may be formed differently or located differently. The fibrous material 16 could, if desired, by advantageously used together with a bead structure, such as that of U.S. Pat. No. 3,884,615, so as to prevent lamp short circuiting by shred ends or fragments that sometimes find their way down below the glass bead. FIG. 3 shows such a lamp construction with an insulating support bead 18, e.g. formed of glass, sealed about the pair of lead-in wires 8 and 10 within envelope 2 at a position spaced from the base press 4. The primer material 12 bridges the ends of the lead-in wires within an aperture in the bead 18. A quantity of the fibrous material 16 extends from the base press 4 to the support bead as shown.

According to another contemplated alternative, the primer could possibly be drop-applied after insertion of the fibrous insulation. By doing this, the fibers would be bonded to the lead wires and thereby tenaciously held in place.

What I claim is:

1. A photoflash lamp comprising:

an hermetically sealed, light-transmitting envelope having a base;

a quantity of filamentary combustible material located with said envelope;

a combustion supporting gas in said envelope;

ignition means disposed in said envelope in operative relationship with respect to said filamentary combustible material, said ignition means including a pair of lead-in wires sealed through said base and extending inside said envelope in a spaced apart relationship, and a mass of primer material covering a portion of at least one of said lead-in wires within said envelope;

and a quantity of electrically nonconducting, noncombustible, fibrous material positioned within said envelope near said base thereof and around at least one of said lead-in wires to reduce the possibility of shorting between said wires.

2. The lamp of claim 1 wherein said filamentary combustible material engages against the outer surface of said quantity of fibrous material and holds said fibrous material in position.

3. The lamp of claim 1 wherein portions of said fibrous material are bonded to said lead-in wires by said primer material.

4. The lamp of claim 1 wherein said quantity of fibrous material extends from said base to said primer material.

5. The lamp of claim 1 wherein said quantity of fibrous material comprises a plurality of fine fibers of material selected from the group consisting of fiberglass, silica, silicates, oxides of reactive metals, mixed oxides, fluoropolymers and fluorosilicones.

6. The lamp of claim 1 wherein said ignition means further includes an insulating support bead sealed about said pair of lead-in wires within said envelope at a position spaced from said base, said quantity of fibrous material extending in said envelope from said base to said support bead.

7. The lamp of claim 1 wherein said primer material is coated on the ends of both of said lead-in wires within said envelope, said respective primer coatings are spaced apart from each other, said filamentary combustible material is in contact with both of said respective primer coatings so as to form an electrically conducting path therebetween for formation of a spark discharge between said lead-in wires and the combustible material through said respective primer coatings upon application of a high voltage pulse across said lead-in wires, and said quantity of fibrous material extends from said base to said coatings of primer material.

8. The lamp of claim 1 wherein the ends of said lead-in wires within said envelope are spaced apart to provide a predetermined gap therebetween, and said mass of primer material bridges said gap between the ends of said lead-in wires.

9. The lamp of claim 8 wherein said fibrous material extends from said base to about the top of said primer bridge.

10. The lamp of claim 9 wherein said quantity of fibrous material comprises a plurality of fine fibers of glass or ceramic type material.

* * * * *